United States Patent [19]

Marquardt

[11] Patent Number: 4,712,079

[45] Date of Patent: Dec. 8, 1987

[54] MOTOR CONTROLLER AUXILIARY CONTACT UNIT WITH FLEXURE MEMBER

[75] Inventor: Terry L. Marquardt, Batavia, Ill.

[73] Assignee: Westinghouse Electric Corp., Pittsburgh, Pa.

[21] Appl. No.: 858,136

[22] Filed: Apr. 30, 1986

[51] Int. Cl.[4] ..... H01H 67/02

[52] U.S. Cl. ..... 335/132; 335/198; 335/159; 335/13; 200/67 DA

[58] Field of Search ..... 335/132, 161, 197, 198, 335/196, 159, 160, 126, 13, 17; 200/67 DA

[56] References Cited

U.S. PATENT DOCUMENTS

| | | | |
|---|---|---|---|
| 2,399,867 | 5/1946 | Hetherington | 200/67 DA |
| 3,324,431 | 6/1967 | Cataldo et al. | 335/132 |
| 3,435,389 | 3/1969 | Mikolic et al. | 335/132 |
| 3,675,168 | 7/1972 | Olley | 335/198 |
| 4,220,835 | 9/1980 | Storz et al. | 200/67 DB |
| 4,642,433 | 2/1987 | Murata | 200/67 DA |

*Primary Examiner*—E. A. Goldberg

*Assistant Examiner*—Lincoln Donovan

*Attorney, Agent, or Firm*—M. J. Moran

[57] ABSTRACT

An auxiliary contact device is taught for utilization with a motor controller or a contactor. A linear cam arrangement is utilized with a rooted flexure arm to cause the contact end of the flexure arm to move in relationship with the linear travel of the stroker carrying the cam surface into a disposition of electrical continuity with a fixed contact. Subsequent linear movement of the stroker in the same direction continues to move the cam surface thereof over an offset in the flexure member after contact has been made. This causes a wiping action between the abutting contact surfaces. The arrangement may be utilized in either the normally open or normally closed disposition. It may be used on multipole devices and the stroker member may be modified for matching a common auxiliary contact assembly arrangement with various kinds of main contactors or controllers or to change timing of contact status change.

3 Claims, 6 Drawing Figures

MOTOR CONTROLLER AUXILIARY CONTACT UNIT WITH FLEXURE MEMBER

BACKGROUND OF THE INVENTION

The subject matter of this invention relates to auxiliary contact units for motor controllers generally and more specifically to separably mountable auxiliary contact units with cam-driven flexure-type contacts.

DESCRIPTION OF THE PRIOR ART

Removable auxiliary contact units or auxiliary switches for contactors are known. Examples of such may be found in U.S. Pat. No. 3,324,431 entitled "Electromagnetic Contactor Having Interchangeable Auxiliary Devices," issued June 6, 1967 to J. B. Cataldo et al. The auxiliary contact is usually actuated in concert with the main contactor to which it is separably attached by the utilization of a movable protrusion or similar member which extends into an appropriate opening or groove in the main contactor casing for being captured by a moving mechanism in the main contactor casing, thus providing synchronous motion with the mechanism of the main contactor. Known auxiliary contact units often utilize bridging contact mechanisms with overtravel springs which are loosely interfitted with the auxiliary contact bridge. However, this kind of assembly can lead to inconsistent and misaligned contact motion which in turn can cause irregular contact wear and consequent degraded electrical performance. One way to overcome this problem is to utilize a deflecting flexure member such as is taught in the switch construction of U.S. Pat. No. 4,220,835 entitled "Electrical Switch Construction," issued Sept. 2, 1980 to Storz et al. By utilizing a flexure member, only a single air gap is created, and this configuration allows at least one part of the contact to be secured in place to improve alignment. In the removable auxiliary contact unit arrangement, movement for the flexure member is usually associated with a driving, rotating cam member which is interconnected with the main contactor bridging member by way of the appropriate protrusion as mentioned previously. Rotary cam actuators are not easily adapted for universal application of a single auxiliary contact unit with a wide range of different host main contactor bodies. It would be desirable to find a camming actuator which could be utilized to move a flexure member in a universal auxiliary contact apparatus which could be utilized for a wide range of different host main contactor assemblies. A linearly driven cam member which interacts with a cam follower which in turn is interconnected with a carrier for bridging-type contacts is shown in U.S. Pat. No. 3,435,389 entitled "Electromagnetic Contactor Having Cam Means For Operating Auxiliary Switch," issued Mar. 5, 1969 to C. R. Mikolic et al. However, this apparatus has the disadvantages of the bridging-type contact mechanism described previously. It would be advantageous to find a linear cam actuator which interacted directly with a flexure-type single pole, single throw contact arm which was reliable, securely held in place, and imposed a contact wiping action during the contact make operation. Another example of this may be found in U.S. Pat. No. 3,382,469, entitled "Electric Control Device and Supplemental Pole Unit", by J. P. Conner, issued May 7, 1968, and assigned to the same assignee as the present invention.

SUMMARY OF THE INVENTION

In accordance with the invention, an auxiliary contact assembly of a type which is detachably attached to an electrical apparatus, such as a motor contactor or controller is taught. The main body of the motor contactor or controller has a movable portion for mechanically engaging or capturing and linearly moving a portion of the auxiliary contact assembly for causing contact status within the auxiliary contact assembly to change. The auxiliary contact assembly includes an insulating base upon which are disposed spaced terminals. An electrically conducting flexure arm with an offset portion is disposed upon the insulating base in a disposition of fixed electrical continuity with one of the spaced terminals and controllable flexed electrical continuity with the other of the spaced terminals for establishing electrical continuity therebetween at an appropriate time. A stroker is taught which is linearly movable within the insulating base in cooperation with the movable portion. The stroker has a cam surface which intercepts the offset portion of the flexure member and causes flexure thereof when the stroker moves for thus effecting the establishment of electrical continuity between the two spaced terminals. Portions of the cam surface may remain in a disposition of interception with the offset portion after electrical continuity has been established but while the stroker continues to move linearly to cause further flexing of the flexure arm, for thus causing a wiping action between the abutted flexure member and terminal.

BRIEF DESCRIPTION OF THE DRAWINGS

For a better understanding of the invention, reference may be had to the preferred embodiment thereof, shown in the accompanying drawings, in which.

DESCRIPTION OF THE PREFERRED EMBODIMENT

Figure 1:
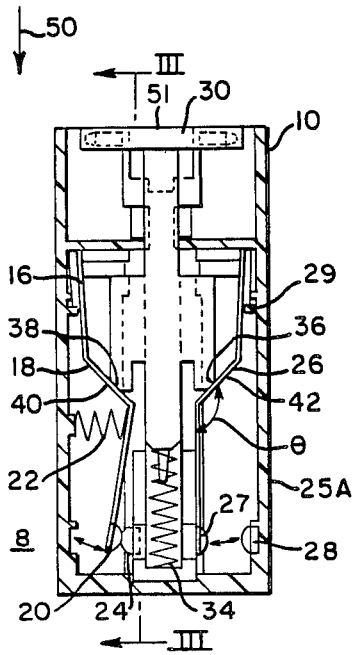
FIG. 1 shows an elevation in section of an auxiliary contact assembly in its normal state and having a normally opened and a separate normally closed flexure switch arrangement.
Figure 2:
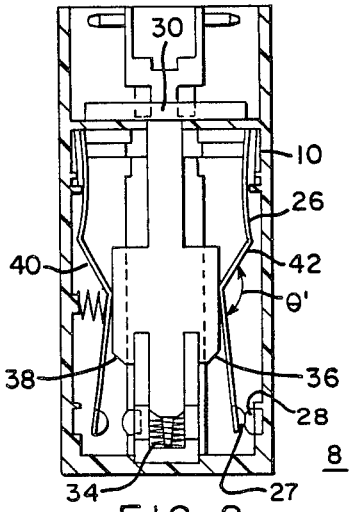
FIG. 2 shows an elevation in section similar to that of FIG. 1 but with the switches in the non-normal state.
Figure 3:
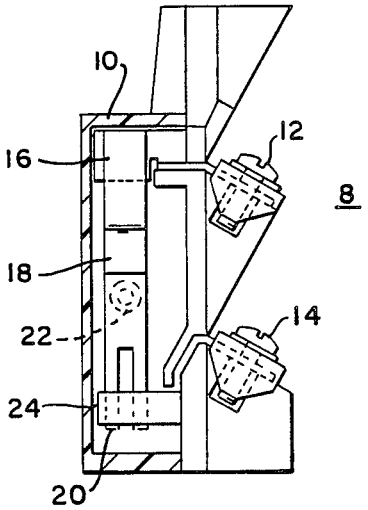
FIG. 3 shows a side elevation of the apparatus of FIG. 1 at a section defined by the section line III—III of FIG. 1.

Referring now to the drawings and FIGS. 1, 2, and 3 in particular, an auxiliary contact apparatus 8 of the type which is detachably attachable to a main contactor or motor controller (neither of which are shown) is depicted. In this embodiment of the invention auxiliary contact 8 has an insulating case or base 10 which may be constructed from thermoplastic material such as polycarbonate or other electrically insulating material and assembled from component parts if desired. There are provided two spaced terminals 12 and 14 disposed on base 10 (as best shown in FIG. 3) for interconnection with a circuit to be controlled by the auxiliary contact apparatus 8. There is interconnected to terminal 12 a fixed, or stationary end or root 16 of a flexure member 18 having a contact 20 secured at the other end thereof which rotates through an arc as a function of the controlled movement of the flexure member 18. This movement is caused by a linear camming operation in a manner to be described hereinafter. With regard to flexure member 18 which is shown disposed in the normally closed contact state in FIG. 1, a biasing spring 22 may be provided which is useful for maintaining flexure member 18 in the normally closed disposition. Alternately, the inherent flexibility of flexure member 18 may maintain it in its normally closed disposition. There is secured to case 10 a mating contact 24 which is interconnected by way of appropriate conducting material to the aforementioned spaced terminal 14. Disposed within the case 10 may be a second flexure member 26 which is disposed in the normally open state in FIG. 1 for controlled interconnection with a fixed contact 28 which in turn is interconnected with a terminal similar to 14 (but not shown herein) for appropriate circuit control upon the closure of flexure member 26 on the fixed contact 28. The surfaces of contact faces 20 and 24, for example, may either or both be cylindrically shaped so as to assist in creating a contact wiping action upon contact closing. There is also provided an electrically insulating stroker member 30 which is slidably, linearly disposed on a combination support and guide member. Stroker member 30 is biased in the position depicted in FIG. 1 by way of a biasing recovery spring 34 so that movement of the stroker member 30 for causing switch status to change and the attendant compression of spring 34 within the case 10 will lead to subsequent recovery to the normal disposition depicted in FIG. 1. Stroker member 30 may have cam surfaces at 38 and 36 for interaction with offset portions 40 and 42, respectively, of the flexure arms 18 and 26, respectively. Movement of the stroker member in the direction 50 by application of force at point 51, for example, on stroker member 30 will cause the stroker member 30 to move from the disposition shown in FIG. 1 to the disposition shown in FIG. 2. As this happens, the normally closed contact arrangement represented by the flexure member 18 and its contact 20 and fixed contact 24 is forced into the open state while the normally opened contact arrangement represented by flexure member 26 and its contact 27 and fixed contact 28 is forced into the closed state. The cam surfaces 38 and 36 cooperate with the respective flexure members as the stroker 30 is moved in the direction 50, to cause the contact ends of the flexure members to move through an arc either into a disposition of electrical contact as is the case with flexure member 26 or out of a disposition of electrical contact as is the case with flexure member 18. Furthermore, in a contact making operation, even after electrical continuity has been established, such as when flexure member 26 causes contacts 27 and 28 to abut, a wiping action is imposed between the contact members 27 and 28 by causing the flexure member to overtravel, thus causing rotation of the curved surface of contact member 27 against contact member 28 as the angle $\theta$ is enlarged from the disposition shown in FIG. 1 to that shown in FIG. 2 (i.e. $\theta'$). This is due to the cam surface 36, riding over the offset portion 42 and flexing it while the flexure member 26 bridges contact face 28 and root 29. The same may be said for the normally closed contact when it once again goes into the closed disposition from the non-normal opened state.

Figure 4:
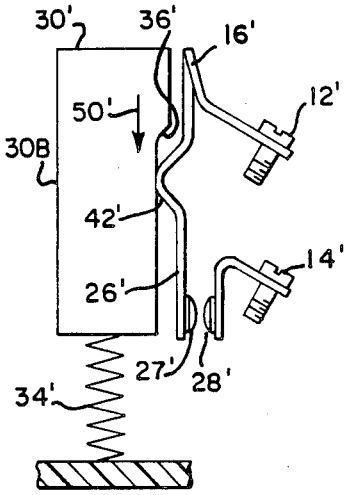
FIG. 4 shows a mechanical schematic representation of an auxiliary switch in which a normally opened contact arrangement is shown in its normal state and where the contact arrangement is axially offset by 90° from that of FIGS. 1, 2 and 3.

Referring now to FIG. 4, another embodiment of the invention is schematically shown in which the contact arrangement and flexure arm are axially rotated 90° with respect to the contact arrangement shown in FIGS. 1, 2, and 3. For purposes and simplicity of illustration, this embodiment of the invention is very similar to that which is shown to the right in FIG. 1 and FIG. 2 in that it comprises a normally open contact arrangement comprising a flexure arm or member 26' which is normally disposed in the open state. It also includes two spaced-apart terminals 12' and 14' which may be similar to terminals 12 and 14 of FIGS. 1, 2 and 3, for example. Terminal 12' is interconnected by way of conducting member 16' to the fixed end or root of the flexure member 26'. At the other end of flexure member 26' may be disposed a contact face 27' which is abuttable against a contact face 28' which in turn is disposed on a conducting member which is interconnected with terminal 14'. In this embodiment of the invention, linear cam member 30B on stroker 30' may move in direction 50' against biasing spring 34' to cause a cam surface 36' to move against offset portion 42' to cause flexure arm or member 26' to rotate through an arc in a direction to cause contact faces 27' and 28' to abut. Further movement of the linear cam means 30B in the direction 50' will cause the continued engagement of cam surface 36' with offset 42' to flex the flexure member 26' at the offset portion 42' to cause the contact surface 27' to wipe against the contact surface 28'. In the arrangement shown in FIG. 4, the flexure member 26' rotates in a plane which is 90° offset from the plane of rotation depicted with respect to FIGS. 1, 2 and 3. Said in another way, this means if the schematically shown apparatus of FIG. 4 were disposed in an embodiment similar to that shown in FIGS. 1, 2 and 3, then the flexure member 26' would rotate in a plane which is perpendicular to the plane of FIGS. 1, 2 and 3.

Figure 5:
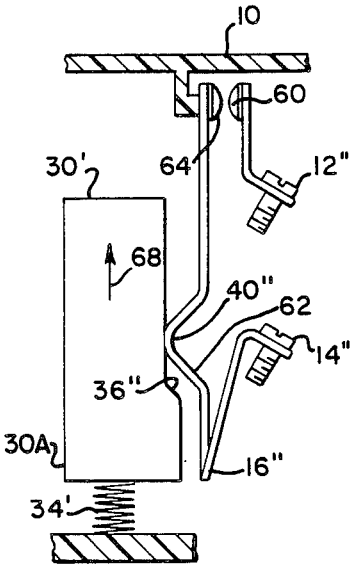
FIG. 5 shows a schematic representation of a switching assembly similar to that shown in FIG. 4 but for a normally closed contact which is nevertheless depicted in its non-normal state or open state.

Referring now to FIG. 5, a schematic version of an arrangement related to that shown with respect to FIG. 4 is depicted for a normally closed contact arrangement (which is nevertheless shown in its non-normal opened state). In this stylized arrangement, a flexure member 62 is secured to an external terminal 14'' at root 16''. A contact 64 is adapted to abut a contact 60 for the terminal 12''. Note that this arrangement is disposed oppositely to what has been described previously with respect to FIG. 4. In this case, biasing spring 34' interacts with cam 30A of stroker member 30' as it is moved in the direction 68 (which is opposite from the direction 50) to cause the normally opened or spaced contacts 64 and 60 to close upon each other with a wiping motion in a manner described previously as cam surface 36'' rides over offset portion 40'', thus causing flexing to take place in flexure element 62 to cause the interconnection of elements 60 and 64 and the subsequent wiping in a manner described previously.

Figure 6:
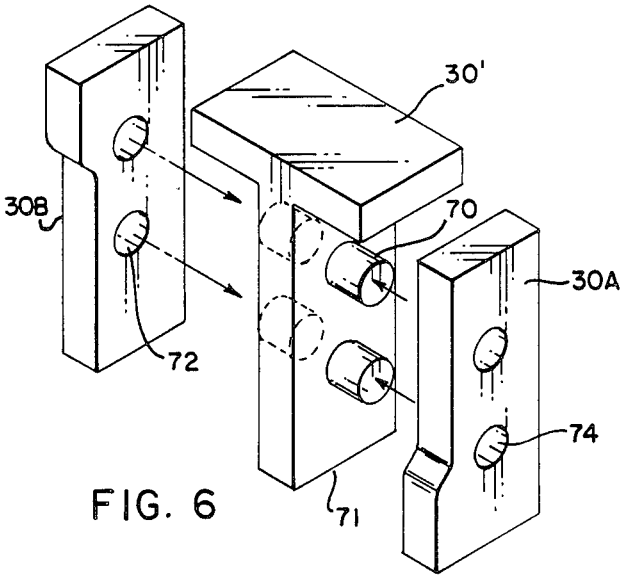
FIG. 6 shows a stroker member with detachably attached cam portions for the embodiments of FIGS. 4 and 5.

Referring now to FIG. 6, the stroker member 30' is depicted orthogonally to show the arrangement of the separably attachable cam members 30A and 30B. Cam member 30A is the one shown with respect to the normally closed contact arrangement of FIG. 5 and cam arrangement 30B is the one associated with the normally opened arrangement of FIG. 4. The cam members 30A and 30B may be attached to the main body 71 of the stroker member by utilizing dowel members 70 in holes or openings 72 and 74 in cam members 30B and 30A, respectively, or by utilization of epoxy gluing or some similar fastening arrangement. By utilizing the arrangement shown in FIG. 6, only one cam member need be manufactured and only one stroker member need be manufactured for an arrangement which can be used on a wide range of host contactors, it being recognized that cam member 30A and 30B may be the same member disposed in reversed arrangement.

It is to be understood with respect to the apparatus taught herein, that the contact arrangements shown in the figures are not limiting. That is to say, more than two poles of contact arrangement may be utilized or one pole may be utilized and, furthermore, the pole arrangements may be both normally open or normally closed. The use of bias springs is non-limiting.

The apparatus taught with respect to the embodiments of this invention have many advantages. One advantage lies in the fact that by utilizing a linear cam arrangement a stroker member such as 30 may be varied in length in order to accommodate the differences between the common arrangement of the remainder of the common auxiliary contact assembly and the various kinds of main host contactors with which it is to be utilized or for varying the timing for contact status change. Therefore, variations in switching functions may be effected by utilizing different molded cams and strokers rather than modifying any of the metal contact arrangements or terminals. Furthermore, by utilizing a flexure member with one end fixed or rooted as opposed to a bridge-type contact member, the contact arrangements tend to be better secured for consistent alignment. Deflection and distortion of the flexure member brings the moving and stationary contacts together to close the circuit and the cam action continues to provide a consistent contact overtravel regardless of the variation and the total stroker movement caused by different controllers for effective contact wiping.

What I claim as my invention is:

1. An auxiliary contact assembly of the type which is detachably attached to an electrical apparatus which has a movable portion for mechanically engaging and linearly moving a portion of the auxiliary contact assembly for causing contact status within said auxiliary contact assembly to change, comprising:

insulating base means;

spaced terminal means disposed on said insulating base means;

electrically conducting flexure means with an offset portion disposed on said insulating base means in a disposition of fixed electrical continuity with one of said spaced terminal means and controllable flexed electrical continuity with the other of said spaced terminal means for establishing electrical continuity therebetween; and stroker means linearly movable within said insulating base means in cooperation with said movable portion and having a cam surface which intercepts said offset portion and moves said flexure means for affecting the establishment of said electrical continuity between said spaced terminal means and for remaining in a disposition of interception with said offset portion after said electrical continuity has been established and while said stroker means continues linear movement for causing further flexing of said flexure means for wiping said other of said spaced terminal means.

2. An auxiliary contact assembly of the type which is detachably attached to an electrical contactor which has a movable portion for mechanically engaging and linearly moving a portion of the auxiliary contact assembly for causing contact status within said auxiliary contact assembly to change, comprising:

insulating base means;

spaced terminal means disposed on said insulating base means;

electrically conducting flexure means with an offset portion disposed on said insulating base means in a disposition of fixed electrical continuity with one of said spaced terminal means and controllable flexed electrical continuity with the other of said spaced terminal means for establishing electrical continuity therebetween; and stroker means linearly movable within said insulating base means in cooperation with said movable portion and having a cam surface which intercepts said offset portion and moves said flexure means for affecting the establishment of said electrical continuity between said spaced terminal means and for remaining in a disposition of interception with said offset portion after said electrical continuity has been established and while said stroker means continues linear movement for causing further flexing of said flexure means for wiping said other of said spaced terminal means.

3. An auxiliary contact assembly of the type which is detachably attached to an electrical apparatus which has a movable portion for mechanically engaging and linearly moving a portion of the auxiliary contact assembly for causing contact status within said auxiliary contact assembly to change, comprising:

insulating base means;

two pairs of spaced terminal means disposed on said insulating base means;

a first electrically conducting flexure means with an offset portion disposed on said insulating base means in a disposition of fixed electrical continuity with one of a first pair of said two pairs of spaced terminal means and controllable flexed electrical continuity with the other of said first pair of said two pairs of spaced terminal means for establishing electrical continuity between said first pair of spaced terminal means;

a second electrically conducting flexure means with an offset portion disposed on said insulating base means in a disposition of fixed electrical continuity with one of a second pair of said two pairs of spaced terminal means and normally biased in a condition of flexed electrical continuity with the other of said second pair of said two pairs of said spaced terminal means for establishing electrical continuity between said second pair of spaced terminal means;

stroker means linearly movable within said insulating base means in cooperation with said movable portion and having two cam surfaces one of which intercepts said offset portion of said first flexure means and moves said first flexure means for affecting the establishment of said electrical continuity between said first pair of spaced terminal means and for remaining in a disposition of interception with said latter offset portion after said electrically continuity has been established and while said stroker means continues linear movement for causing further flexing of said flexure means for wiping the other of said first pair of said spaced terminal means, the other cam surface of said stroker means intercepting and moving said second flexure means for affecting the interruption of said electrical continuity between said second pair of spaced terminal means.

* * * * *